United States Patent [19]

Zwicky

[11] Patent Number: 4,980,921

[45] Date of Patent: Dec. 25, 1990

[54] MAGNETIC SYSTEM FOR DYNAMIC LOUDSPEAKER

[75] Inventor: Paul Zwicky, Dielsdorf, Switzerland

[73] Assignee: Willi Studer AG, Regensdorf, Switzerland

[21] Appl. No.: 883,385

[22] Filed: Jul. 8, 1986

[30] Foreign Application Priority Data

Jul. 17, 1985 [CH] Switzerland ..... 03102/85

[51] Int. Cl.[5] ..... H04R 9/06

[52] U.S. Cl. ..... 381/194; 381/199; 381/201

[58] Field of Search ..... 381/194, 192, 198, 199, 381/200, 201

[56] References Cited

U.S. PATENT DOCUMENTS

| | | | |
|---|---|---|---|
| 2,026,994 | 1/1936 | Messick | 381/200 |
| 2,141,595 | 12/1938 | Cornwell | 381/199 |
| 2,223,496 | 12/1940 | Price | 381/199 |
| 3,079,472 | 2/1963 | Sarati | 381/199 |
| 3,134,057 | 5/1964 | Tsunoo et al. | 381/199 |
| 3,240,882 | 3/1966 | Eichler | 381/199 |
| 3,261,927 | 7/1966 | Paul et al. | 381/199 |
| 3,482,062 | 12/1969 | Hecht | 381/194 |
| 3,783,311 | 1/1974 | Sato et al. | 381/199 |
| 3,881,074 | 4/1975 | Kawamura | 381/194 |
| 3,935,399 | 1/1976 | Lian | 381/194 |
| 4,118,605 | 10/1978 | Kobayashi | 381/194 |
| 4,289,937 | 9/1981 | Ikeda et al. | 381/199 |
| 4,293,741 | 10/1981 | Digre | 381/199 |
| 4,295,011 | 10/1981 | Hathaway | 381/194 |
| 4,427,845 | 1/1984 | Yoshida | 381/199 |
| 4,492,827 | 1/1985 | Shintaku | 381/199 |
| 4,547,632 | 10/1985 | Bryson | 381/194 |
| 4,580,015 | 4/1986 | O'Neill | 381/199 |
| 4,661,973 | 4/1987 | Takahashi | 381/194 |

FOREIGN PATENT DOCUMENTS

| | | |
|---|---|---|
| 594490 | 3/1934 | Fed. Rep. of Germany . |
| 51-138431 | 5/1975 | Japan . |
| 911411 | 11/1062 | United Kingdom . |
| 7213250 | 1/1955 | United Kingdom . |

*Primary Examiner*—James L. Dwyer

*Attorney, Agent, or Firm*—Sandler Greenblum & Bernstein

[57] ABSTRACT

A simple technique permits improving the distortion of a loudspeaker with a magnetic system. The magnetic system incorporates measures for operation thereof within the saturated region of the magnetic characteristic of the magnetic system. These measures comprise a division of the magnetic circuit into a section with magnetic saturation, and sections without magnetic saturation, which are adjacent to an air gap.

8 Claims, 2 Drawing Sheets

MAGNETIC SYSTEM FOR DYNAMIC LOUDSPEAKER

BACKGROUND OF THE INVENTION

The present invention broadly relates to a new and improved construction of a magnetic system for a dynamic loudspeaker, suitable for sound reproduction with reduced sound distortion, i.e. enhanced sound fidelity.

In its more specific aspects the present invention relates to a new and improved construction of a magnetic system for a dynamic loudspeaker, comprising a magnetic path with an air gap, in which there is arranged at least one movable conductor which is movable in a predetermined direction of movement and which is connected to a current source.

Dynamic loudspeakers include current conducting conductors, most always arranged within a voice coil, which submerges into an annular magnetic field. The voice coil may, for instance, be connected to an amplifier which delivers electrical signals, which are to be transduced into acoustical signals. These electrical signals provide a deflection of the voice coil within the magnetic field, respectively in the air gap, while a diaphragm can be actuated by means of the voice coil.

For practical purposes, the emission of low frequency sounds of sufficient magnitude is only possible by means of voice coil systems. The sound reproducing fidelity of dynamic loudspeakers, however, is limited due to various causes, such as non-linear restoring force within the suspension system of the diaphragm, non-linear restoring force caused by the air cushion within the loudspeaker box or enclosure, non-uniformity of the magnetic field within the air gap, self-resonance of the diaphragm and the loudspeaker box, eddy currents and hysteresis within the yoke of the drive system of the diaphragm, and so forth.

It is well known that the sound reproduction fidelity of dynamic loudspeakers can be improved by certain measures within the voice coil or the diaphragm and its suspension system. It is further known that the fidelity of dynamic loudspeakers can be improved by the use of large and strong magnetic systems.

The disadvantages of these known solutions involve either high technical complexity, high cost and complications, or, for simple constructions, result in large, heavy and expensive loudspeaker systems. In principle, however, with magnetic systems of such large dimensions, the force exerted upon the voice coil, which is driving the diaphragm, is not exactly proportional to the current flowing within the voice coil. The current within the voice coil, on the one hand, generates an additional excitation within the magnetic circuit, i.e. within the entire magnetic path, comprising a suitable energizer, the pole pieces and the air gap, and, on the other hand, a variation of the magnetic field within the air gap alone.

The additional excitation within the magnetic path is a function of armature feedback, as is present in electrical drive systems. This additional excitation within the magnetic path, of which &.he magnitude is a function of direction of current flow within the voice coil, causes an increase or reduction of the magnetic field strength within the entire path, including the air gap. This in effect means, that with a constant current, the force propelling the voice coil outwardly is smaller than the force propelling it inwardly. Acoustically, this effect causes second order sound distortions. Furthermore, the center point of the oscillations of the voice coil becomes dislocated towards the inside with respect to the magnet, the effect of which is generally known as mechanical rectification. As a result the maximum possible deflection amplitude is also reduced.

The deviation of magnetic field strength within the air gap alone manifests itself through a decrease of magnetic field strength across the depth of the air gap. This decrease changes with the direction or with the amplitude of the current flow within the voice coil. Japanese Pat. application No. 51-138431 describes an arrangement which has the purpose of eliminating the disadvantages of the aforementioned variations within the magnetic field in the air gap and to provide means for eliminating current distortions within the voice coil. It has been proposed therein to provide means, in parts of which the magnetic flux is partially saturated, and such means are arranged immediately adjoining the air gap. Thus, there can be avoided that the current within the voice coil becomes adversely affected by a changing magnetic field within the air gap.

The aforementioned problems are also already known from U.S. Pat. No. 4,295,011, granted Oct. 13, 1981. The undesirable effects of the auxiliary magnetic field, which is generated by the moving, current-carrying voice coil, are sought to be improved by the provision of constructive measures at the adjoining surfaces of the air gap located between the poles. It is the purpose of these measures to focus the magnetic field within the air gap. In this proposal, as well as in the aforementioned Japanese Pat. application No. 51-138431, the magnetic field undergoes a modification within the air gap, in order to exert a positive influence upon the voice coil. Thus, the magnetic field within the entire magnetic path is not affected. There is merely modified the magnetic field within the air gap alone.

It is further known from German Pat. No. 594,490, granted Mar. 17, 1934, and the aforementioned U.S. Pat. No. 4,295,011, that saturation can be maintained within the entire magnetic circuit associated with the air gap. According to this U.S. Pat. No. 4,295,011 this brings improvements within the motion of the voice coil. According to the aforementioned German Pat. No. 594,490, such a saturated magnetic path can have a positive influence, whenever this saturated magnetic path is operated in parallel with an unsaturated magnetic path. The positive effect consists in the elimination of hum in the loudspeaker, whenever pulsating dc-current is used for exciting a magnetic circuit. It is, however, again very difficult to construct magnetic circuits which are saturable over the entire length of the magnetic path. A saturated magnetic circuit means that the magnetic reluctance has the same value as the magnetic reluctance within the air surrounding the magnetic circuit. The magnetic field in that case might choose different paths rather than the one leading through the air gap. In this case, additional solutions must be found in order to avoid these disadvantages, which, in turn, causes an increase of costs.

SUMMARY OF THE INVENTION

It is an important object of the present invention to provide means for constructing a simple, lightweight and inexpensive magnetic system for low distortion, dynamic loudspeakers.

Now in order to implement this and other objects of the invention which will become more readily apparent as the description proceeds, the invention contemplates a magnetic system for a dynamic loudspeaker and defining a magnetic path having an air gap subject to a magnetic flux. The dynamic loudspeaker comprises movable conductor means connected to a power source and movable in a predetermined direction of movement. The magnetic path of the magnetic system comprises means for limiting the magnetic flux within the air gap. The limiting means limit the magnetic flux within the air gap such that the magnetic path comprises at least one first section in which magnetic saturation prevails and at least one second section in which magnetic saturation is absent and which are located adjacent to the air gap.

The essential advantages achieved in accordance with the invention consist in the applicability thereof to constructions of small as well as large magnetic systems. The high value of differential magnetic resistance within the proximity of the operating point of the magnetic curve of the magnetic system results in a low inductance within the voice coil. This results in a better frequency response at the high frequency end of the sound range, and thus a better reproduction of the high frequency sound spectrum. Contrary to known compensating systems for compensating the additional excitation generated by the voice coil by applying accurate correcting means only within the center portion of the voice coil, the solution according to the invention provides for a uniform improvement over the entire length of the voice coil displacement path. If the magnetic system is constructed according to the invention, only few problems will occur during manufacture of these magnetic systems, because the magnetic flux changes which are produced by differences between individual manufactured components of the magnetic system, have only negligible effect on the magnetic flux in the air gap and thus hardly have any influence on the performance of the loudspeaker. The magnetic flux in the air gap thus is substantially constant and permits large manufacturing tolerances, so that mass produced loudspeakers may all perform equally well.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
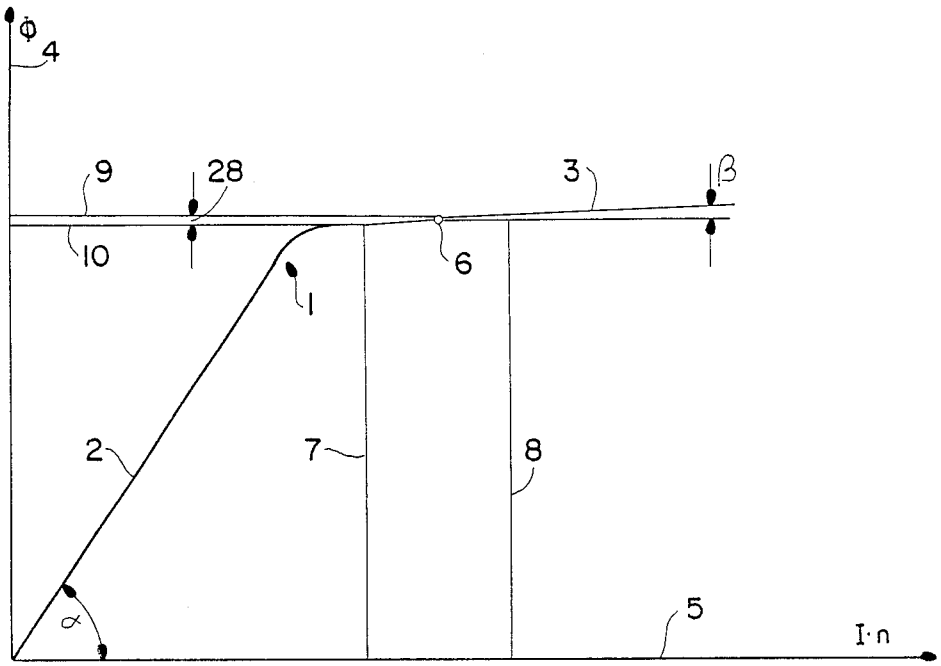
FIG. 1 shows a characteristic diagram of a magnetic system.

Describing now the drawings, it is to be understood that to simplify the showing thereof only enough of the structure of the magnetic system for dynamic loudspeakers has been illustrated therein as is needed to enable one skilled in the art to readily understand the underlying principles and concepts of this invention. Turning now specifically to FIG. 1 of the drawings, the magnetic system illustrated therein by way of example and not limitation will be seen to comprise a characteristic curve 1 for a predetermined magnetic system. This characteristic curve 1 displays a linear region 2 and a saturation region 3, the principles which are generally known. This characteristic curve 1 lies between ordinate and abscissa axes 4 and 5. The vertical or ordinate axis 4 represents the values of the magnetic flux $\phi$, and the horizontal or abscissa axis represents the values for the product of current I and the number of turns $n$ for excitation of the magnetic system.

This characteristic curve 1 indicates that within the linear region 2, an increase of current in the coil causes a proportional increase in magnetic flux. This curve also demonstrates that within the saturation region 3 an increase of current hardly produces any increase of magnetic flux. Moreover, the excitation can be changed either by means of the magnetic system, the coil, or both.

The reference numeral 6 designates the proposed operating point of the magnetic system in accordance with the teachings of the present invention. Lines 7 and 8 denote possible limits for changes of the factor derived from the product of current and number of coil-turns (I·n). Such changes cause respective changes of magnetic flux $\phi$, which lie within the limits defined by lines 9 and 10.

Figure 2:
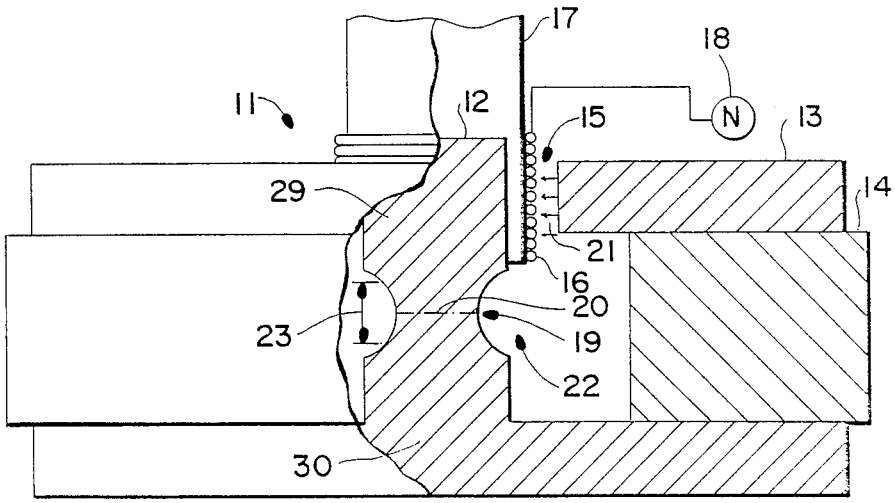
FIG. 2 shows a simplified depiction of a magnetic system constructed according to the invention.

FIG. 2 depicts a magnetic system 11 having a magnetic path and provided for a dynamic loudspeaker. This magnetic system 11 essentially comprises a pole piece 12, a yoke or pole disk 13, a permanent magnet 14 serving as an energizer, and an air gap 15. The magnetic system 11 is assumed to be configured rotationally symmetrical, which in turn, results in an annular air gap 15. A voice coil 16 arranged on a bobbin 17 is connected to a current source 18. Current sources, such as the current source 18 may consist of known audio amplifiers. It is further known that the bobbin 17 is connected to a conventional loudspeaker diaphragm, not particularly shown. The voice coil 16 consists of at least one movable conductor having a number of turns and which drives the bobbin 17.

Figure 4:
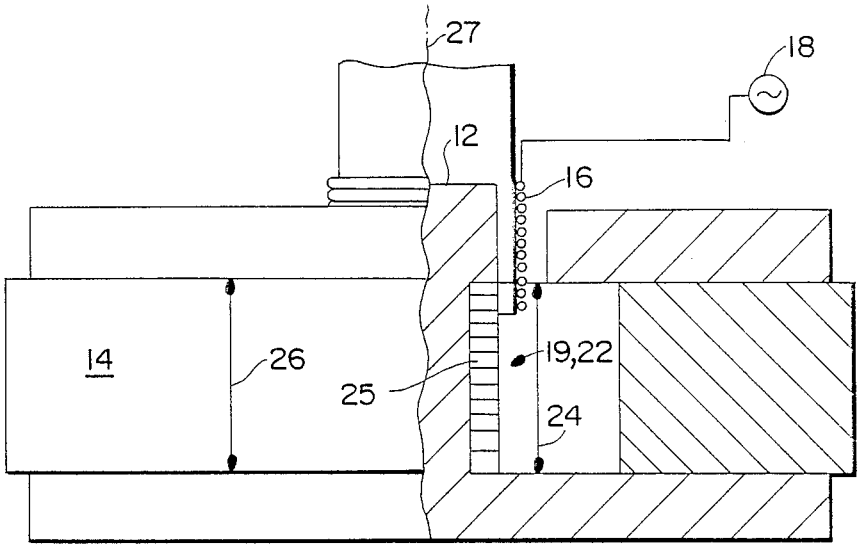
FIG. 4 shows still another embodiment analogous to FIG. 2.

The pole piece 12 comprises a constriction 19 which defines a cross-section 20 and forms a first, constricted section 22, as particularly shown in FIGS. 2 and 4. In a given magnetic material of the pole piece 12 the action of the magnetic field produced by the magnet 14 produces a magnetic flux which is dependent upon the tube of material and the cross-sectional area of the pole piece 12. In the first constriction section 22 having the small cross-section 20, the magnetic flux density can be sufficient to produce magnetic saturation. If two sections of different cross-sectional areas are series arranged as shown in FIG. 2, the magnetic flux is insufficient to saturate the wider second sections 29 and 30 but sufficient to saturate the first constricted or narrower section 22. A further increase of the magnetic flux density cannot be achieved and, therefore, the magnetically saturated first, constricted section 22 precisely limits the magnetic flux along the magnetic path in the magnetic system 11. As a result of the saturation of the first, constricted section 22, changes in the magnetic flux in the non-saturated second sections 29 an 30 remain without effect on the magnetic flux in the saturated first, constricted section 22. Therefore the flux density 21 within the magnetic path as well as within the air gap 15 is limited. The air gap region or air gap 15 can not be magnetically saturated.

Figure 3:
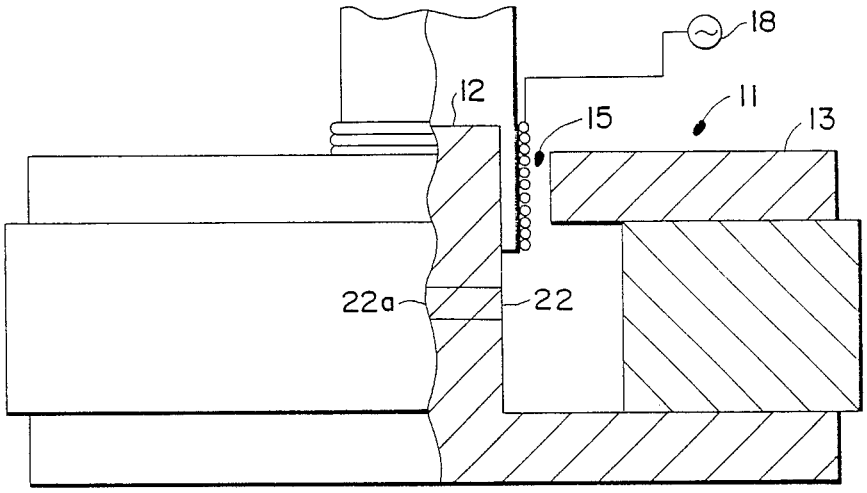
FIG. 3 shows another embodiment analogous to FIG. 2.

FIG. 3 depicts a magnetic system 11 which is similar to the one depicted in FIG. 2. The pole piece 12 therein includes a first section 22 containing a member or element 22*a* consisting of material which is magnetically saturated at a lower magnetic field than the material used for the pole piece 12 and/or disk 13 which constitute at least one magnetically non-saturated second section.

FIG. 4 depicts a magnetic system 11 with a pole piece 12 comprising a constriction or necked down portion 19 defining a precisely determined or dimentioned cross-section which has a length 24 and defines a section 22 which is in magnetic saturation. This length 24 corresponds to the physical extension of the permanent magnet 14, or generally speaking, to the physical extension of the energizing means in the direction of the axis 27 of the voice coil 16. In a preferred embodiment this aforementioned constriction or necked down portion 19 is filled by a short-circuiting ring 25, e.g. made of copper.

The operating principle of the arrangement according to the present invention, includes a precisely determined or dimensioned cross-section 20 or a precisely determined or dimensioned saturation indiction which defines a first section 22 at a location within the magnetic system 11, which fixes the operating parameter 6 of the magnetic system 11, such that a small change of energization leads to only a minute change of magnetic flux.

It is particularly desirable to attain a total magnetic energization or excitation within the magnetic system 11, which is a composite of the constant biasing influence or excitation by the permanent magnet 14 and the variable energization or excitation by the voice coil 16, which results in a total magnetic flux lying within the saturation region 3 of the characteristic curve 1 of the magnetic system 11. The result thereof is that current changes within the voice coil 16 cause practically no changes of the magnetic flux $\phi$ and thus no changes within the magnetic field 21. Consequently, this means that the force deflecting the voice coil 16 is practically dependent only upon and is proportional to the current flowing through the voice coil 16. Thus, there result only extremely small distortion coefficients in dynamic loudspeakers equipped with magnetic systems of the type hereindescribed and constructed according to the present invention.

The slope $\alpha$ of the linear section 2 of the characteristic curve 1 is determined by the previously mentioned magnetic reluctance of the magnetic path, whereas all materials involved are operated below their magnetic saturation. The slope $\beta$ of the saturating region 3 of the characteristic curve 1 is determined by the reluctance of the magnetic path provided that certain sections within the magnetic path are operating beyond their magnetic saturation limit. The longer the extension length (FIG. 2) or 24 (FIG. 4) of the constriction or necked down portion 19 of the related or first section 22 of the pole piece 12, the smaller is the slope $\beta$ of the saturation region 3. Residual magnetic flux changes 28 (FIG. 1) within the magnetic path can be further reduced by means of a short-circuiting ring 25 as will be explained more fully shortly with respect to FIG. 4. The effect of this short-circuiting ring 25 becomes more pronounced with increasing frequency. Such first sections 22 which may be defined by constrictions 19 or made of different kinds of materials, as respectively shown in FIGS. 2 and 4 and in FIG. 3 by the member or element 22*a*and which limit the magnetic flux, may be arranged anywhere within the magnetic path. However, as the length of such sections have a critical influence, not all locations within the magnetic path are equally suitable. It is desirable to obtain a slope $\beta$ of the saturation region 3, which is as low or as flat as possible, as this condition provides for a minimum influence of the magnetic field generated by the voice coil 16. It is preferable to arrange such first sections 22 within the pole piece 12, but not in close proximity to the air gap 15.

While there are shown and described present preferred embodiments of the invention it is to be distinctly understood that the invention is not limited thereto, but may be otherwise variously embodied and practiced within the scope of the following claims. ACCORDINGLY,

What I claim is:

1. A dynamic loudspeaker containing movable conductor means connected to a power source and movable in an air gap of a magnetic system defining a magnetic path including said air gap and subject to a magnetic flux, said dynamic loudspeaker comprising:

means provided in said magnetic path for limiting the magnetic flux within said magnetic path;

said limiting means limiting the magnetic flux within said magnetic path, comprising at least one magnetically saturated first section and at least one magnetically non-saturated second section; and said at least one magnetically non-saturated second section being located adjacent to the air gap in said magnetic path.

2. The dynamic loudspeaker as defined in claim 1, wherein:

said at least one magnetically saturated first section constitutes a section possessing a precisely dimensioned crosssectional area;

said at least one magnetically non-saturated section possessing a predetermined cross-sectional area; and said precisely dimensioned cross-sectional area of said at least one magnetically saturated first section being smaller than said predetermined cross-sectional area of said at least one magnetically non-saturated second section.

3. A dynamic loudspeaker containing movable conductor means connected to a power source and movable in an air gap of a magnetic system defining a magnetic path including said air gap and subject to a magnetic flux, said dynamic loudspeaker comprising:

means provided in said magnetic path for limiting the magnetic flux within said magnetic path;

said limiting means limiting the magnetic flux within said magnetic path, comprising at least one magnetically saturated first section and at least one magnetically non-saturated second section;

said at least one magnetically non-saturated second section being located adjacent to the air gap in said magnetic path; and said at least one magnetically saturated first section comprising a material which is magnetically saturated at a lower magnetic field than the material of said at least one magnetically non-saturated second section.

4. The dynamic loudspeaker as defined in claim 1, wherein:

said movable conductor means comprises a voice coil having an axis;

said at least one magnetically saturated first section having a predetermined length measured in the direction of the axis of said voice coil;

said magnetic path incorporating a magnet serving as an energizer and having a predetermined length measured in the direction of the axis of said voice coil; and said predetermined length of said at least one magnetically saturated first section corresponding to said predetermined length of said energizing magnet.

5. The dynamic loudspeaker as defined in claim 1, wherein:

the magnetic path of the magnetic system is defined at least in part by a pole piece defining said at least one magnetically saturated first section.

6. The dynamic loudspeaker as defined in claim 5, further including:

a short-circuiting ring surrounding said pole piece at the location of said at least one magnetically saturated first section.

7. A magnetic system for a dynamic loudspeaker, comprising;

magnetic energization means for providing magnetic flux in the magnetic system;

a pole disk;

a pole piece;

said pole disk and said pole piece cooperating with said magnetic energization means;

said pole disk and said pole piece conjointly defining an air gap therebetween;

said pole piece defining at least one magnetically saturated first section of the magnetic path;

said pole piece defining at least one magnetically non-saturated second section of the magnetic path; and said at least one magnetically saturated first section of said pole piece being arranged neighboring but not immediately proximate to the air gap and limiting the magnetic flux in the magnetic path.

8. A dynamic loudspeaker comprising:

a magnetic system;

said magnetic system defining a magnetic path and a magnetic flux within said magnetic system along said magnetic path;

said magnetic system incorporating an air gap;

limiting means provided in said magnetic system for limiting said magnetic flux along said magnetic path defined by said magnetic system;

said limiting means comprising at least one magnetically saturated section of said magnetic path;

said magnetic path containing at least one magnetically non-saturated section; and said at least one magnetically non-saturated section of said magnetic path being arranged immediately proximate to said air gap.

* * * * *